United States Patent [19]

DeBleyker

[11] Patent Number: 4,891,543

[45] Date of Patent: Jan. 2, 1990

[54] INCANDESCENT LAMP HAVING AN IMPROVED ARBOR

[75] Inventor: James R. DeBleyker, Lyndhurst, Ohio

[73] Assignee: General Electric Company, Schenectady, N.Y.

[21] Appl. No.: 187,168

[22] Filed: Apr. 28, 1988

[51] Int. Cl.[4] ..... H01B 5/48

[52] U.S. Cl. ..... 313/315; 313/318; 313/317; 313/314; 313/276

[58] Field of Search ..... 313/314–318, 313/275–278, 292, 238

[56] References Cited

U.S. PATENT DOCUMENTS 1,398,032 11/1921 Maurer ..... 313/277

1,682,916 6/1923 Lebby ..... 313/277

*Primary Examiner*—Leo H. Boudreau

*Assistant Examiner*—Michael Razavi

*Attorney, Agent, or Firm*—John P. McMahon; Stanley C. Corwin; Fred Jacob

[57] ABSTRACT

A rough service incandescent lamp having a flexible arbor comprised of a stainless steel member that joins a glass stem press to a filament mounting structure is disclosed. The stainless member is selected to have a coefficient of expansion that both matches the coefficient of expansion of the glass stem press and of a glass cane member of the filament mounting structure. The stainless steel member allows for simplification of the fabrication process related to forming the rough service incandescent lamp while also improving the shock capability of such a lamp.

3 Claims, 1 Drawing Sheet

INCANDESCENT LAMP HAVING AN IMPROVED ARBOR

BACKGROUND OF THE INVENTION

The present invention relates to a rough service incandescent lamp, more particularly, to a flexible arbor comprising a stainless steel member that joins the stem press and the filament mounting structure in such manner as to improve the shock capability of the rough service incandescent lamp.

Incandescent lamps find various industrial applications that require the lamp to withstand a sufficient amount of shock such as that which may be experienced with usage of such a lamp with a drop cord fixture at auto repair facilities. Such incandescent lamps are typically provided with a ruggedized filament mounting structure. It is desired that means be provided for arranging the filament mounting structure within the incandescent lamp so as to allow the filament to be subjected to increased shock impacts without causing any failure of the filament.

Accordingly, it is an object of the present invention to provide means for arranging the filament mounting structure within the incandescent lamp that increases the shock withstanding capabilities of the filament.

SUMMARY OF THE INVENTION

The present invention is directed to a rough service incandescent lamp having a flexible arbor comprised of a stainless steel member that improves the shock withstanding capability of the filament.

The rough service incandescent lamp comprises a glass envelope, an electrically conductive base, a glass stem, a mounting structure for a filament, and a flexible arbor for joining the mounting structure to the glass stem. The glass envelope has a neck portion to which is joined the electrically conductive base. The glass stem is affixed to the conductive base and encases inleads which are appropriately connected to the base. The structure for mounting the filament has conductive members axially extending within the envelope and respectively connected between the inleads of the stem and the filament. The mounting structure further comprises a glass cane member having encased therein members for supporting the filament. The flexible arbor joins the glass cane member to the glass stem and comprises a stainless steel member having a coefficient of expansion selected to match the coefficient of expansion of each of the glass cane member and the glass stem.

DETAILED DESCRIPTION OF THE PREFERRED EMBODIMENT

Figure 1:
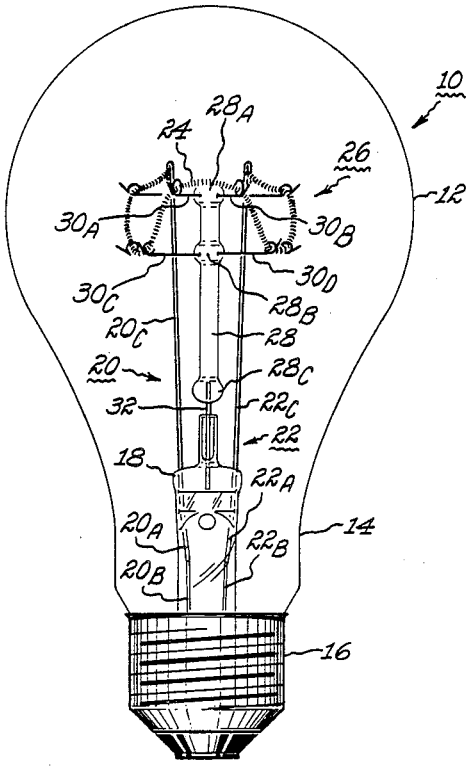
FIG. 1 the only drawing the present invention illustrates a rough service incandescent lamp in accordance with the present invention.

FIG. 1 illustrates a rough service incandescent lamp 10 in accordance with the present invention. The lamp comprises an outer glass envelope 12 having a neck portion 14 to which is connected an electrically conductive base 16. The incandescent lamp further comprises a glass stem 18 having one end affixed to the conductive base 16 and encasing portions $\mathbf{20}_A$ and $\mathbf{22}_A$ of inleads 20 and 22 respectively. The portions $\mathbf{20}_A$ and $\mathbf{22}_A$ are preferably of a wire type to serve as fuse elements for the lamp 10. The inlead 20 further comprises portions $\mathbf{20}_B$ and $\mathbf{20}_C$, whereas, inlead 22 further comprises portions $\mathbf{22}_B$ and $\mathbf{22}_C$. The portions $\mathbf{20}_B$ and $\mathbf{22}_B$ are appropriately and electrically connected to the conductive base 16. The portions $\mathbf{20}_C$ and $\mathbf{22}_C$ axially extend within the envelope 12 and are connected to opposite sides of filament 24 and also route the excitation for a filament 24 to achieve its incandescent state.

A structure 26 mounts and rigidly supports the filament 24. The mounting structure 26 is comprised of a glass member 28, having a cane like shape, and a plurality of support members $\mathbf{30}_A$, $\mathbf{30}_B$, $\mathbf{30}_C$, and 30D. The cane member 28 has three elements $\mathbf{28}_A$, $\mathbf{28}_B$, and $\mathbf{28}_C$ each having a button like shape. The button like elements $\mathbf{28}_A$ and $\mathbf{28}_B$ have encase therein the mounting members $\mathbf{30}_A$ and $\mathbf{30}_B$ and $\mathbf{30}_C$ and 30D respectively. The button member $\mathbf{28}_C$ has encased therein a flexible arbor 32 which is of importance to the present invention and joins the cane member 28 to the stem 18.

The flexible arbor 32 is comprised of a stainless steel member preferably of the #302 type. The #302 type stainless steel member is comprised of an alloy comprised of iron, nickel and chromium. The arbor 32 is of a flexible nature so that the intensity of a mechanical shock sensed by the filament is reduced. The flexible arbor 32 is of a diameter in the range of about 18 mil to about 26 mil. The flexible arbor 32 is selected to have a coefficient of expansion in the range of about 1.0 to about 1.2. This coefficient of expansion closely matches the coefficient of expansion of the glass cane member 28 and also of the glass stem 18. The selected coefficient of expansion of the flexible arbor 32 eases the manufacturing process of the lamp by allowing the insertion of the flexible arbor, in its cold state, into molten glass of the cane member 28 and also into the stem 18 in its molten state so as to allow the respective glass material to flow around the flexible arbor to form a tight seal between the arbor and each of these glass members and thereby eliminating any need for pinching or pressing operations typically involved with such manufacture. It is believed that the much greater mass of glass related to either the cane member 28 and the stem member 18, relative to that of the mass of the flexible arbor 32, allows for advantageous sealing of the cold arbor without inducing glass thermal stresses which are detrimental to the related glass and arbor seal strengths.

The present invention represents a substantial improvement over the known prior art flexible arbors comprised of a carbon steel commonly known as music wire used for rough service incandescent lamps. The prior art flexible arbor having a music wire required the application of heat to the music wire before it was mated with the glass cane member 28 and also to the stem 18 which is not necessary for the present invention. The applied heat subsequently anneals the music wire and thereby reduces its bend strength capability. Further the stainless steel member of the present invention is of a lower cost than that of the music wire and therefore yields a corresponding reduction in the manufacturing cost of the related rough service incandescent lamp.

In addition to the simplification of the manufacturing process related to the rough service incandescent lamp employing the stainless steel flexible arbor, this stainless steel flexible arbor also improves the shock capability of the filament mounting structure and therefore the related rough service incandescent lamp. The prior art rough service incandescent lamp having the flexible music wire arbor was tested relative to the present invention employing the stainless steel flexible arbor. A series of lamps each embodying their respective music wire or stainless steel member were subjected to drop testing. In one series of drop testing, the respective lamps were placed in a extension light fixture and then energized. The fixture was dropped onto a hard floor from an elevation of about 30 inches. The lamps having the stainless shell arbor had a failure rate which was less than the lamps of the music-wire arbor by a factor of about 3. In another series of drop testing, the respective lamps were packed in appropriate packing sleeves and dropped onto a carpeted floor from an elevation of about 30 inches. The lamps employing a music wire indicated moderate to severe bending when encountering between 1 to 2 drops, whereas, the stainless steel flexible arbor lamps of the present invention did not exhibit any discernible bending after between 8 to 10 drops. The overall effect of the present invention is to increase the shock capability of the rough service incandescent lamp.

It should now be appreciated that the practice of the present invention provides for a rough service incandescent lamp having a flexible arbor comprised of a stainless steel member which not only simplifies manufacturing process of such lamps but also improves the shock capability of such lamps.

What I claim as new and desire to secure by Letters Patent of the United States is:

1. A rough service incandescent lamp comprising:
(A) a glass envelope having a neck portion:
(B) an electrically conductive base joined to said neck portion:
(C) a glass stem affixed to said conductive base and encasing portions of inleads appropriately and electrically connected to said base:
(D) a structure for mounting a filament, said mounting structure being connected to a portion of said inleads which axially extend within said envelope and connect to said filament, said mounting structure further having a glass cane member having encased therein members for supporting the mounting of said filament; and
(E) a flexible arbor for joining said glass cane member to said glass stem, said flexible arbor comprising a stainless steel member having a coefficient of expansion selected to match the coefficient of expansion of each of said glass cane member and said glass stem.

2. A general service incandescent lamp according to claim 1 wherein said coefficient of expansion is in the range of abut 1.0 to about 1.2.

3. A rough service incandescent lamp according to claim 2 wherein said stainless steel member is of a #302 alloy.

* * * * *